US005864919A

United States Patent [19]

Pineda

[11] Patent Number: 5,864,919

[45] Date of Patent: Feb. 2, 1999

[54] POWER LEAF BAGGER

[76] Inventor: Horacio D. Pineda, 604 Burtis St., Bricktown, N.J. 08723

[21] Appl. No.: 828,433

[22] Filed: Mar. 28, 1997

[51] Int. Cl.[6] ..... A47L 5/18

[52] U.S. Cl. ..... 15/409; 15/339; 417/197

[58] Field of Search ..... 15/409; 417/197

[56] References Cited

U.S. PATENT DOCUMENTS

| | | | |
|---|---|---|---|
| 5,117,531 | 6/1992 | Hentzschel | 15/409 |
| 5,511,281 | 4/1996 | Webster | 15/409 X |
| 5,522,115 | 6/1996 | Webster | 15/409 X |
| 5,673,457 | 10/1997 | Webster et al. | 15/409 X |

FOREIGN PATENT DOCUMENTS

| | | | |
|---|---|---|---|
| 1159333 | 2/1958 | France | 15/409 |
| 1253621 | 8/1986 | U.S.S.R. | 15/409 |
| 2152362 | 8/1985 | United Kingdom | 15/409 |

*Primary Examiner*—Chris K. Moore

[57] ABSTRACT

A lawn maintenance apparatus for the collection of leaves, lawn debris or particulate matter, the apparatus comprised of a fixed tubular duct member having an ingress opening and an egress opening, an annular collar proximate to the ingress opening and in communication with air blower means for the introduction of pressurized air flow into the fixed tubular duct member in the direction of the egress opening, a perforated collection bag securable to the egress opening of the fixed tubular duct member and a telescoping tubular duct member retractably secured to the egress opening and extendable into the collection bag to insure the complete filling of the collection bag.

2 Claims, 5 Drawing Sheets

FRONT PERSPECTIVE

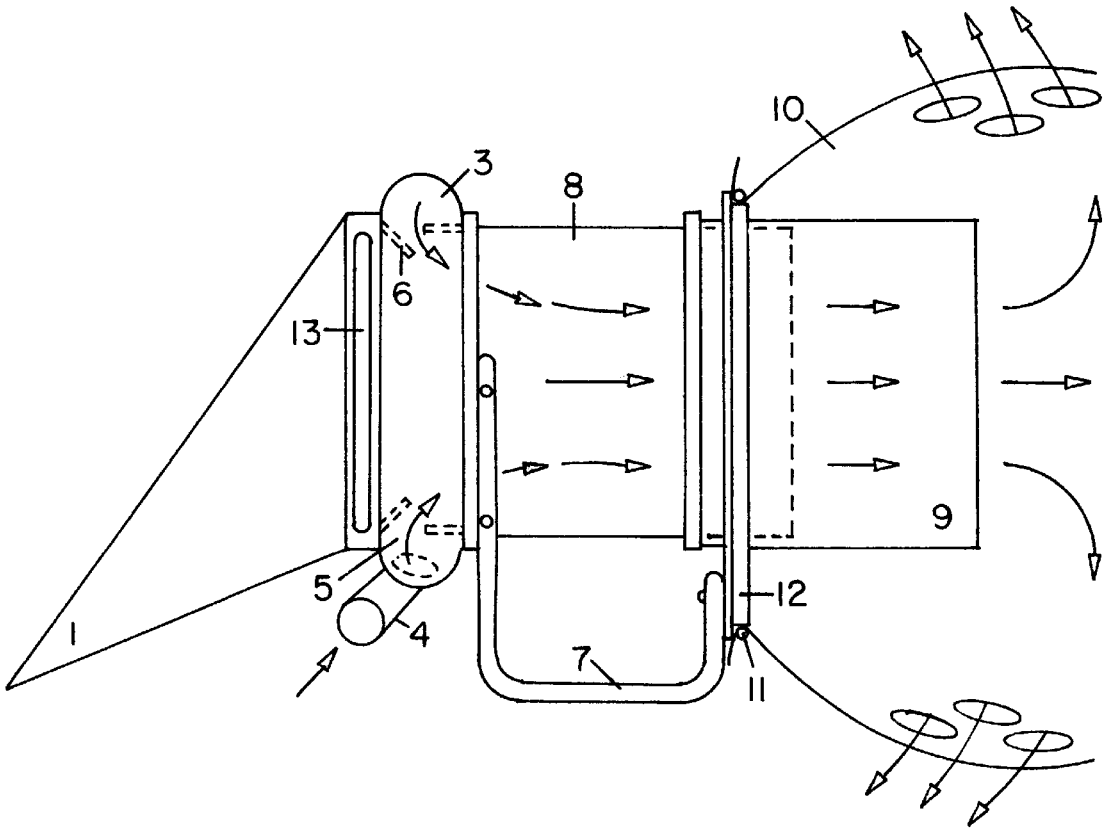
Figure 1. SIDE VIEW

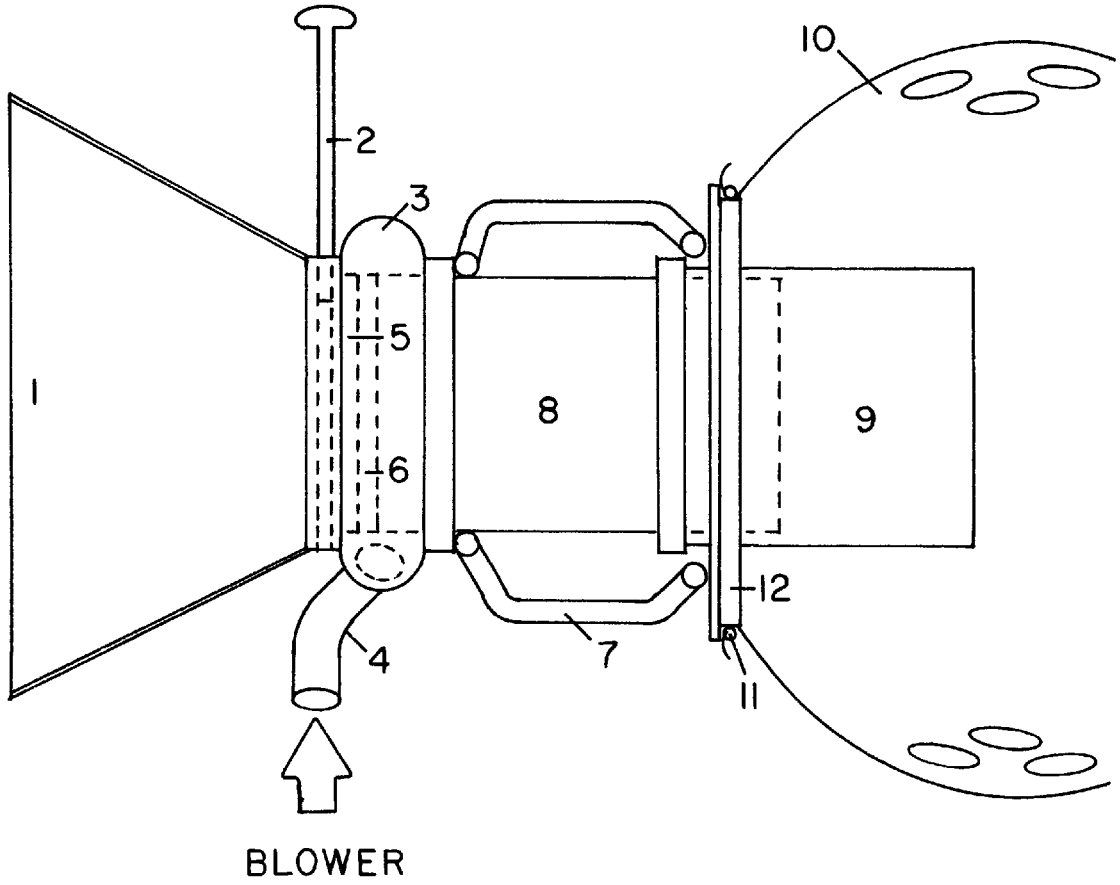
Figure 2. TOP VIEW

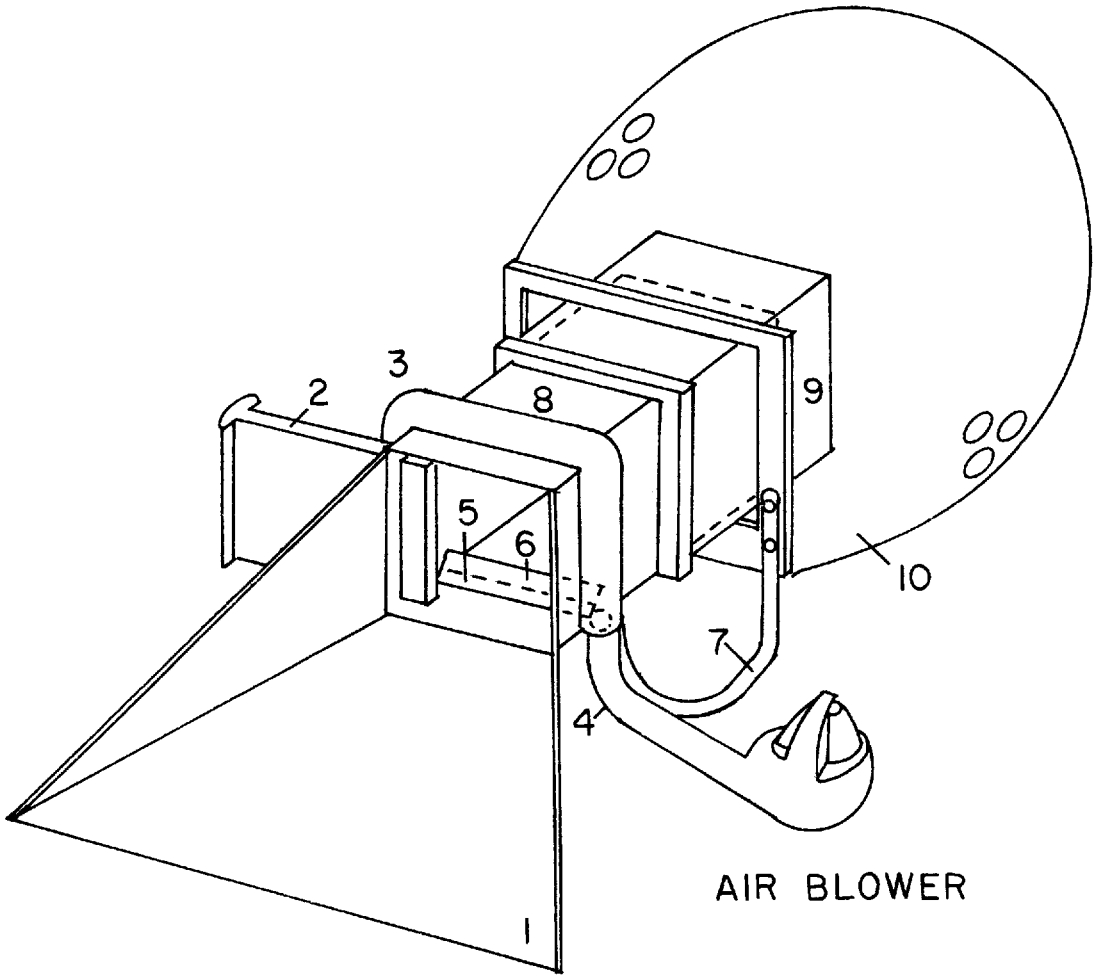
Figure 3. FRONT PERSPECTIVE

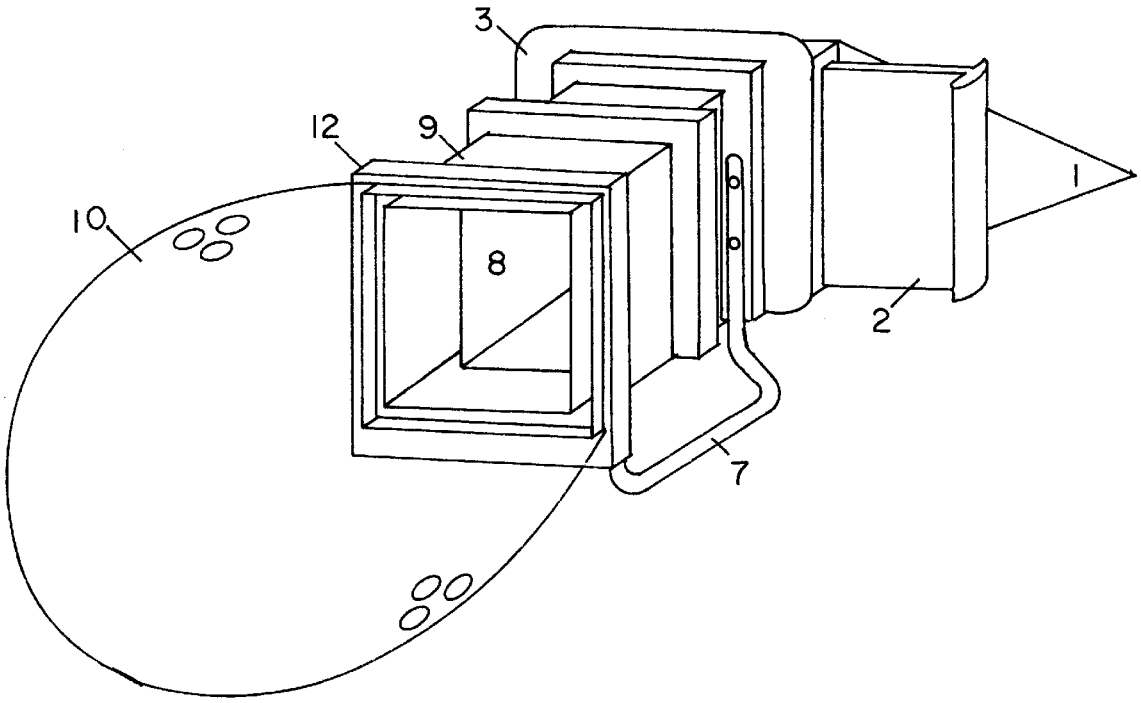
Figure 4. REAR PERSPECTIVE

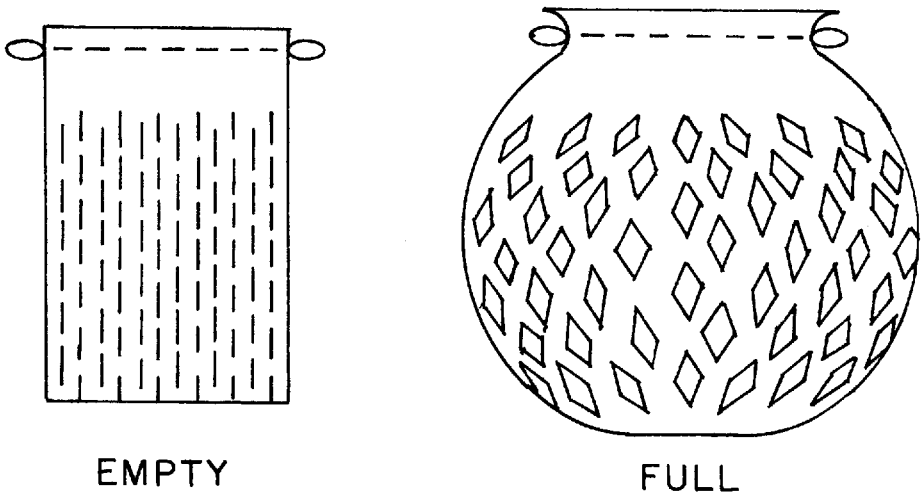
Figure 5. COLLECTING BAG

POWER LEAF BAGGER

BACKGROUND OF THE INVENTION

1. Field of the Invention

The invention relates to a novel collecting and bagging apparatus for leaves and other lawn debris, to be used in conjunction with a common lawn/garden blower or an attached air-blowing machine for lawn maintenance.

2. Description of the Prior Art

Numerous devices have been developed and commercialized for the collection of trash, leaves and other refuse. Equipment for blowing debris and bagging and collecting trash are well developed in the prior art. Examples of the prior art include U.S. Pat. No. 5,031,277 to Coker; U.S. Pat. No. 5,107,564 to Grumbles; and U.S. Pat. Des. No. 299,075 to Scott. Other examples of prior art comparable in function to the present apparatus include U.S. Pat. No. 5,088,531 to Wade; U.S. Pat. No. 4,615,069 to Henning; U.S. Pat. No. 4,644,606 to Luerken et al.; U.S. Pat. No. 5,440,781 to Kitazawa et al.; U.S. Pat. No. 5,522,115 to Webster; and U.S. Pat. No. 5,511,281 to Webster.

Several of the previously invented devices embody a device wherein a porous collecting bag is attached to a common garden lawn air-blower for use in vacuuming and shredding lawn debris. See U.S. Pat. No. 4,615,069 to Henning; U.S. Pat. No. 4,644,606 to Luerken et al.; U.S. Pat. No. 5,440,781 to Kitazawa et al.; U.S. Pat. No. 5,522,115 to Webster; and U.S. Pat. No. 5,511,281 to Webster. The above devices have several disadvantages which make the present apparatus distinguishable, to wit: 1] those devices are only usable for small clean-ups of the lawn, as those devices are too inefficient to collect large volumes of leaves and debris, or to clean the entire lawn; 2] those devices will have difficulty in collecting and bagging small twigs; and 3] each of those devices involve carrying around a motor with a collecting bag manually, making use of the device laborious due to the weight of those lawn appliances.

U.S. Pat. Des. No. 299,075 to Scott and U.S. Pat. No. 5,088,531 to Wade are waste collecting devices which operate much like the house-hold dustpan. Waste is manually pushed into the aforementioned devices. In Scott's invention, a small bag is attached to a hand-held "pan" for minor clean-ups. Wade's device involves manually pushing yard waste into a collection structure which will compress materials therein for deposit into larger containers. The disadvantage to the above objects are: 1] that the devices are unpowered in operation, so that the entire method in operating them is manual; 2] Scott's device in operation involves difficulty in fully packing the collapsible bag, because debris that is shoved into the bag may block the ingress; 3] Wade's invention necessitates the extra step of dumping the collected/compacted debris into another container.

U.S. Pat. No. 5,031,277 to Coker and U.S. Pat. No. 5,107,564 to Grumbles are devices used for the collection and bagging of leaves and lawn debris, employing a lawn air blower to direct debris into the aperture of a porous collecting receptacle. Both devices have the following disadvantages: 1] both use a heavy handheld air blower which weighs 7 lbs. or more, making use of the devices more laborious; 2] difficulty in compacting or filling the far end of the collecting bag or basket; 3] Grumble's method necessitate the extra step of emptying the basket into another receptacle; 4] the apparatus are basically unpowered; and 5] to employ an airblower to direct leaves into a narrow aperture is difficult since the turbulence caused by the directed air spreads leaves outward.

U.S. Pat. No. 5,031,277 which issued in 1991 to Coker and U.S. Pat. No. 5,107,564 which issued in 1992 to Grumbles when combined teach the main structural elements that can be inferred from the presently applied—for mechanism. (See above). However, the prior art does not directly suggest combining a power assisted blower to continue a manual raking process to an automated bagging operation as disclosed below. This aspect when claimed structurally is not suggested by Coker, in view of Grumbles nor as combined with the other prior art discussed.

OBJECT OF THE INVENTION

It is an object of the present invention to provide for a novel piece of lawn maintenance equipment which more efficiently utilizes the airflow created by a air-blower to push debris directly into a disposable collection bag.

It is an additional object of the invention to provide for a novel piece of lawn maintenance equipment which is more energy efficient.

SUMMARY OF THE INVENTION

The present invention comprises a frame apparatus with a posterior opening fastened with a removable, disposable slotted bag; incorporated to the frame are a power blower and tubes directing air through the aforementioned apparatus. It also comprises a powered method for collecting debris using the disclosed apparatus in conjunction with garden rakes.

More specifically, the disclosed apparatus is comprised of a rigid frame structure with a funnel opening at the frontage and an opening at the rear to which is attached a large, slotted, disposable bag. An air blower is connected to the frame just behind the front aperture by tubes, directing an airflow through the apparatus to the posterior opening. Leaves and light debris that are raked into the front funnel aperture will be pushed by the directed air into the slotted bag attached to the posterior opening.

The rigid frame may be made from light plastic material or aluminum. The collecting bag can be of standard commercial lawn bag material; however, these bags must be perforated with longitudinal slits or holes, to allow excess air pressure to escape, thus preventing pressure build-up within the collecting bag which can result in back-flow.

Between the funnel opening and the bag is an extendible conduit, allowing a telescoping duct to elongate into the attached bag, so that debris may be pushed into the farthest end of the bag. This extendible conduit will prevent any obstructions near the front of the bag before the farthest end of the bag is filled. The telescoping duct may be retracted as the bag fills with debris. This ensures a more compact packing of the bag.

A sliding door is located at the narrow part of the funnel aperture before the air slits. Should debris obstruct the main conduit, the door may be closed, directing the full force of the air rear-ward without possibility of back-flow. This will remove any obstruction and deposit same to the bag. Once the obstructions are removed, the door can be pulled open, to resume normal operation of the device.

The structure is made portable by attaching a sled or wheels to the bottom of the frame.

The present invention also provides a method of collecting trash and leaves using the disclosed apparatus. The apparatus is brought to a previously gathered pile of leaves. A regular garden rake is used to direct the leaves into the front funnel. The internal airflow generated from the attached blower will push the leaves through the conduit and into the bag automatically.

The use of a disposable, perforated lawn bag eliminates the added step of transferring the garden debris to another receptacle as outlined by the prior art. The perforations will be smaller than the garden debris being collected, so that they will be strained within the bag. The cuts along the surface of the bag must be oriented parallel to the long axis of the bag to ensure the bag's strength. Slits made perpendicular to the length of the bag will cause the bag to break. When the bag is full of leaves, the cut slits will allow the bag to expand sideways, thus increasing capacity while retaining longitudinal strength. See FIG. 5, attached). Once filled, the bag may be removed from the apparatus and disposed of.

Therefore, it is an object of the present invention to provide 1] a leaf and lawn debriscollecting appliance and 2] a method that does not involve a manual transfer of debris into a container.

Please refer to the detailed description and drawings that follows.

BRIEF DESCRIPTION OF THE DRAWINGS

FIG. 1 is a side view of the apparatus of one embodiment of the present invention, illustrating the directed air current generated by the blower through the conduit and into the bag.

FIG. 2 is a top-view perspective of the apparatus of the present invention.

FIG. 3 is a front-view perspective of the apparatus displaying the funnel opening.

FIG. 4 is a rear-view perspective of the apparatus with an attached bag.

FIG. 5 is a side view of a bag perforated wit h longitudinal slits. The bag is displayed in an empty state and in a filled state.

DETAILED DESCRIPTION OF THE PREFERRED EMBODIMENTS

The preferred embodiments of the invention are described with reference to the FIGS. 1–4 wherein like numbers represent like parts throughout the views.

As shown in the figures, the tremendous air pressure generated by the air blower is directed by means of flexible and rigid conduits (4) to two tubes (3) located at the superior and inferior portion of a fixed duct part (8). These tubes each contain thin longitudinal slits (5) to allow jets of pressurized air to flow into the interior of the fixed duct part. To direct flow of air aft of the fixed duct part (8), fixed flaps (6) point the air towards the rear and also prevents back flow of air. The duct part is essentially a part of a large funnel laying on its side. It is made up of a fixed inner tube (8) and an adjustable, telescoping outer tube (9) which allows the length of the duct part to vary. It corresponds to a conduit linking a large, forward, flared, receiving end (1) and a removable, disposable, large plastic bag (10) connected to the fixed bag frame (12) using a large rubber band (11). A sliding door (2, FIGS. 2. 3, 4) located between the forward, flared, funnel end-and the duct part, just before the air slit flaps, allows closure of the front of the duct part to concentrate the full force of air rearward to clear any obstructions.

The instrument is positioned near a pile of leaves or garden debris to be bagged. The telescoping outer duct (9) is advanced until its opening rests about the midpoint within the collecting plastic bag. This ensures that the furthermost end of the bag gets filled first. The power source, the air blower is turned on. Leaves are raked onto the flared funnel opening (1). As the leaves reach the narrow neck of the funnel, two jets of air coming from the thin air slits (5) above and below, propel them through the duct part rearward and into the multiperforated, disposable, collecting plastic bag (10). The bag perforations are smaller than the leaves, so that they allow trapping of leaves within the bag, while allowing excess air pressure to escape- filling the bag from bottom to top. When the bottom portion of the bag is filled, the telescoping outer duct (9) is retracted fully back allowing the upper half of the bag to be filled. When the bag is filled up, it is removed and closed with a drawstring, ready to be discarded. A new perforated bag is replaced to continue the process. If the duct part happens to get clogged, sliding the door (2) in the closed position directs the full force of the air rearwards thus clearing any obstruction.

While the present invention has been described in connection with the exemplary embodiments, it will be understood that many modifications will be apparent to those of ordinary skill within the art; and that this application is intended to cover any adaptations or variations thereof. Therefore, it is manifestly intended that this invention be only limited by the claims and the equivalents.

What is claimed is:

1. An apparatus for collecting leaves, lawn debris, or particulate matter comprising:

a fixed tubular duct member mounted on a transport means, said fixed tubular duct member having a first end defining a first opening for the ingress of leaves, lawn debris and particulate matter, and a second end defining a second opening for the egress of leaves, lawn debris or particulate matter;

an annular collar formed about said fixed tubular duct member proximate to said first opening of said fixed tubular duct member, said annular collar having an annular slotted opening in communication with the interior of said fixed tubular duct member and angled toward said second opening of said fixed tubular duct member, said annular collar in communication with an air blower means for the introduction of pressurized air flow into said fixed tubular duct member in the direction of said second opening of said fixed tubular duct member;

a perforated collection bag removably securable about said second opening of said fixed tubular member;

a tubular telescoping duct member slidably secured to said second end of said fixed tubular duct member, said telescoping tubular duct member slidably extendable into said perforated collection bag so as to direct said leaves, lawn debris or particulate matter to bottom of said bag, said telescoping tubular duct member being retractable as said perforated collection bag is filled.

2. The apparatus in accordance with claim 1 wherein said first end of said fixed tubular duct member has positioned thereon a retractable door for sealing engagement with said first end of said tubular duct member to prevent the ingress of leaves, lawn debris or particulate matter and to permit said air blower means, in cooperation with said annular collar to clear any leaves, debris or particulate matter which may be obstructing said fixed tubular duct member or said telescoping tubular duct member.

* * * * *